United States Patent [19]

Suzuki et al.

[11] 4,338,389

[45] Jul. 6, 1982

[54] CDS-BINDER MEMBER FOR ELECTROPHOTOGRAPHY WITH FE, CO, NI ADDITIVES

[75] Inventors: Kiyoshi Suzuki, Yokohama; Kazumi Okano, Fuchu, both of Japan

[73] Assignee: Canon Kabushiki Kaisha, Tokyo, Japan

[21] Appl. No.: 190,411

[22] Filed: Sep. 24, 1980

[30] Foreign Application Priority Data

Oct. 4, 1979 [JP] Japan ..... 54/128326

[51] Int. Cl.[3] ..... G03G 5/087; G03G 5/09

[52] U.S. Cl. ..... 430/94; 430/95; 252/501.1

[58] Field of Search ..... 430/94, 95; 252/501.1

[56] References Cited

U.S. PATENT DOCUMENTS

| | | | |
|---|---|---|---|
| 3,310,502 | 3/1967 | Komatsubara et al. | 252/501.1 X |
| 3,743,609 | 7/1973 | Hirata et al. | 430/94 X |
| 4,021,237 | 5/1977 | Kawashima et al. | 430/94 X |

FOREIGN PATENT DOCUMENTS

| | | | |
|---|---|---|---|
| 1031864 | 6/1966 | United Kingdom | 430/95 |

*Primary Examiner*—Roland E. Martin, Jr.

*Attorney, Agent, or Firm*—Fitzpatrick, Cella, Harper & Scinto

[57] ABSTRACT

In a photosensitive member for electrophotography comprising a photoconductive layer containing photoconductive cadmium sulfide particles dispersed in a binder material, the member comprises a particular additive to the photoconductive layer, said additive being selected from the group consisting of iron, nickel, cobalt and compounds thereof.

3 Claims, 1 Drawing Figure

CDS-BINDER MEMBER FOR ELECTROPHOTOGRAPHY WITH FE, CO, NI ADDITIVES

BACKGROUND OF THE INVENTION

1. Field of the Invention

The present invention relates to a photosensitive member for electrophotography of the type which comprises a photoconductive layer containing photoconductive cadmium sulfide particles dispersed in a binder. More particularly, the present invention is directed to improvements in the properties of such photosensitive member by adding a particular additive to the photoconductive layer. According to the invention, the additive is selected from the group consisting of iron, nickel, cobalt and compounds of said metals. The photosensitive member containing such additive is less affected by the conditions under which it was kept before use and therefore unfavorable variation in contrast of electrostatic images produced through the photosensitive member is substantially reduced.

2. Description of the Prior Art

In the art, various types of photosensitive members have been known and used. The construction which a particular photosensitive member has to have is determined depending upon the desired properties for the photosensitive member as well as the type of electrophotographic process in which the photosensitive member is applied.

One typical photosensitive member for electrophotography hitherto widely used has a structure comprising a substrate and a photoconductive layer formed on the substrate. Another typical example is of the type which comprises a top layer of an electrically insulating layer in addition to the substrate and photoconductive layer. The photosensitive member comprising a substrate and a photoconductive layer is used for forming images in accordance with the commonest electrophotographic process comprising the steps of charging, imagewise exposure, developing and, if necessary, transferring. The photosensitive member having an insulating top layer mentioned above is used also in the same electrophotographic process and is useful for other particular electrophotographic process. The function of the insulating layer is to protect the photoconductive layer, to improve the mechanical strength and dark decay of the photosensitive member and also to prevent environmental pollution.

Examples of such photosensitive member having an insulating layer in addition to substrate and a photoconductive layer and examples of electrophotographic processes employing such photosensitive member are disclosed, for example, in U.S. Pat. Nos. 2,860,048; 3,146,145; 3,607,258; 3,666,363; 3,734,609; 3,457,070; 3,124,456 and Japanese Patent Publication No. 16,429/1966.

As a matter of course, a photoconductive material used for electrophotography is required to have a predetermined sensitivity, electrical property and also optical property appropriate for the electrophotographic process in which the material is intended for use.

One of the most important factors by which the properties of a photosensitive member are determined is photoconductive material. The material most frequently used as a photoconductive material for electrophotography is pulverized cadmium sulfide. For cadmium sulfide particles commonly used for electrophotography it is essential to adequately control the amount of doping impurity, condition for precipitation, condition for calcination which is carried out to disperse the doped impurity and also condition for after-treatment, since the surface characteristics of formed cadmium sulfide particles are variable depending upon these manufacturing conditions. However, it is not easy to adequately control these conditions and to obtain cadmium sulfide particles having desired surface characteristics. The property of cadmium sulfide for electrophotography is much more affected by surface characteristics of particles rather than by bulk characteristics of particles. Under above-mentioned conditions there is sometimes produced such cadmium sulfide having many traps formed on the particle surface. When such cadmium sulfide is used to form a photosensitive member, the photosensitive medium will show the following drawbacks. One of the drawbacks is found in that the photoconductive layer, when actually used for image formation, exhibits variation in resistance according to the condition under which the photosensitive member was kept. Namely, the photoconductive layer has different resistances according to whether is has been exposed to light or not during storage. Another drawback is that the light photodecay thereof is also variable according to the storage condition.

Hitherto the above mentioned drawbacks have been considered not to be of critical importance. However, with the great advancement of image forming technique in these years the drawbacks appears as an important problem against further improvement of image quality of copies. To satisfy the desire for higher image quality, the difference in resistance and photodecay mentioned above must be minimized. In other words, it is essential that the cadmium sulfide itself has a high resistance and the photosensitive member containing the cadmium sulfide exhibits always stable and rapid photodecay irrespective of storage conditions.

Conventionally it has been tried to obtain the finally desired properties of the photosensitive member by 1. changing the amount of impurity for doping and
2. changing the conditions for sintering.

However, these measures can not always give the desired properties.

SUMMARY OF THE INVENTION

It is the primary object of the present invention to provide an improved photosensitive member which is less affected by variations in storage conditions and which always exhibits an instantaneous photodecay, in other words, instantaneously erasing effects resulting from a pre-exposure and various exposures carried out in the preceding electrostatic image forming process.

Other and further objects, features and advantages of the invention will appear more fully from the following description.

According to the present invention, there is provided a photosensitive member for electrophotography having a photoconductive layer formed by dispersing photoconductive cadmium sulfide particles in a binder, which is characterized in that said photoconductive layer contains an additive selected from the group consisting of iron, nickel, cobalt and compounds thereof.

BRIEF DESCRIPTION OF THE DRAWING

In the accompanying drawing, the single FIGURE schematically shows a measuring apparatus for measuring the photosensitive properties of a photosensitive member.

DESCRIPTION OF THE PREFERRED EMBODIMENTS

Figure 1:
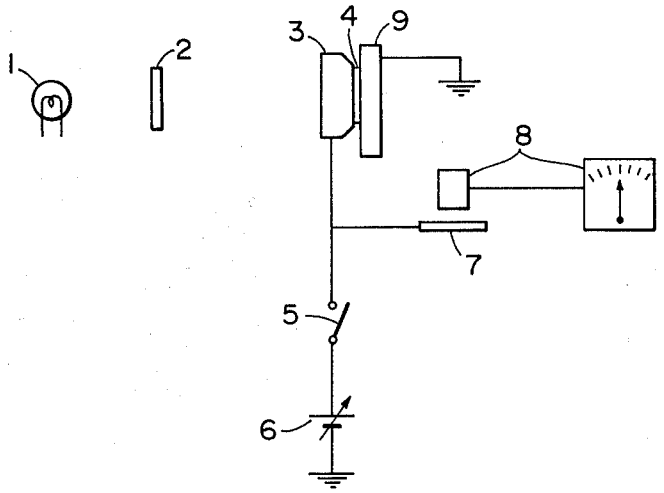

There may be mentioned iron, nickel, cobalt and salts thereof as the additive usable for the present invention. These materials may be used in any state in which the materials are soluble in the solvent for diluting the binder. Salts such as chlorides are preferred in view of solubility. Also, by adding iron and an acid such as HCl separately there may be obtained the same effect as that obtainable by directly adding an iron salt.

The amount of additive useful for attaining the object of the invention is variable within a wide range. The effect is appreciable when there is used $1\times10^{-5}$ parts by weight of the additive per 1 part by weight of binder. Too high concentration of the additive will reduce the sensitivity of the produced photosensitive layer itself to the extent in which the photosensitive member is no longer usable for electrophotography. Upper limit of the concentration is $6\times10^{-4}$ parts by weight per 1 part by weight of the binder. While the optimum amount of the additive varies depending upon the resistance value of cadmium sulfide to be used, the range of from $5\times10^{-5}$ to $3\times10^{-4}$ parts by weight per 1 part by weight of the binder is generally preferred.

When the additive is present in a binder in an amount within the above-mentioned range, a clear effect is obtained. However, the mechanism with which the effect is produced has not been ascertained yet. From the fact that the range of concentration within which the additive can exhibit the effect is very wide, it is considered that the additive is not only deposited on the surface of cadmium sulfide particle but also acts on the interface between the particle and binder as well as in the binder.

The photosensitive medium prepared in accordance with the invention shows always high resistance irrespective of the conditions under which it has been kept before use. The photodecay of the photosensitive member remains constant in substance and is scarcely affected by the difference of conditions under which it has been kept. Therefore, with the photosensitive medium there are obtained continuously good images in a high speed copying process.

The photosensitive medium according to the invention may be prepared as any of two typical constructions. One is the two layer type comprising a substrate and a photoconductive layer. The other is the three layer type comprising a substrate, a photoconductive layer and an insulating layer laid on the photoconductive layer.

Examples of conductive substrates are stainless steel, Al, Cr, Mo, Au, In, Nb, Ta, V, Ti, Pt, Pd and their alloys. An example of an insulating substrate is glass. Another example of an insulating substrate is synthetic resin film. In case of glass, its surface is, if necessary, conductivized with $In_2O_3$, $SnO_2$ or the like. When the substrate is a synthetic resin film such as polyimide film, it is treated with a suitable metal such as Al, Ag, Pb, Zn, Ni, Au, Cr, Mo, Ir, Nb, Ta, V, Ti, Pt or the like employing a known technique such as vapour deposition in vacuum, electron beam vapour deposition, sputtering or lamination.

The photoconductive layer is formed by dispersing photoconductive particles in binder.

As the binder there may be used various known insulating resins. Examples of suitable binders include polyethylene, polyester, polypropylene, polystyrene, polyvinyl chloride, polyvinyl acetate, acrylic resin, polycarbonate, silicone resin, fluorocarbon resin, epoxy resin, and the like.

The photoconductive layer contains the binder in an amount of from 0.5 to 50 parts by weight and preferably from 5 to 20 parts by weight per 100 parts by weight of photoconductive particles.

While the thickness of the photoconductive layer is variable according to the type and characteristics of the photoconductive layer then used, it is preferably in the range of 5 to 100 microns and particularly preferably in the range of 10 to 50 microns.

For the photosensitive member provided with an insulating layer there may be used various conventional resins to form the insulating layer. Examples of resins useful for this purpose include polyethylene, polyester, polypropylene, polystyrene, polyvinyl chloride, polyvinyl acetate, acrylic resin, polycarbonate, silicone resin, fluorocarbon resin, epoxy resin and the like. Generally, the thickness of the insulating layer ranges from 0.1 to 100 microns and particularly from 0.1 to 50 microns.

The following examples illustrate the present invention without, however, limiting the same thereto.

EXAMPLE 1

0.0005 g of ferric choride was dissolved in a small volume of butyl acetate and then the resulting solution was mixed with a solution of 3.6 g of vinyl chloride-vinyl acetate copolymer resin in methyl ethyl ketone and methyl isobutyl ketone. Stirring was continued until a homogeneous solution was obtained. The solution was added to 30 g of cadmium sulfide and the latter was thoroughly dispersed in the solution. After adjusting the viscosity of the mixture, it was coated on a substrate formed of aluminum to form a layer of 40 microns in thickness on the substrate. After drying, a film of polyester was further allowed to adhere onto the photoconductive layer. Thus, three layer type photosensitive members were obtained.

COMPARATIVE EXAMPLE 1

The photosensitive members were obtained in the same manner as that described in Example 1 except that the solution of vinyl chloride-vinyl acetate copolymer resin in methyl ethyl ketone and methyl isobutyl ketone was used without ferric chloride dissolved in butyl acetate.

In the two manners described above, two sheets of photosensitive medium were prepared, respectively. Of the two sheets one was left standing under exposure to light and the other was kept in dark, respectively.

The photosensitive characteristics of the samples were measured with the measuring apparatus shown in FIG. 1.

Measurements were conducted in the following manner:

The photosensitive member 9 is brought into contact with a glass plate 3 provided with a transparent electrode 4. The transparent electrode 4 is connected to a high voltage DC power source 6 through a relay switch 5. The relay switch 5 is closed for 0.2 seconds to apply a high voltage (Va) to the sample and then the switch is opened. After leaving the sample 9 alone for 0.2 seconds (the relay switch is open), it is illuminated for 0.2 seconds and the change in surface voltage of the photosensitive member 9 caused by the illumination is measured by means of a metal plate 7 lying under the same voltage as that of the surface of the photosensitive member and a surface electrometer 8. Vp, that is, the voltage applied to the photoconductive layer of the sample prior to the illumination, is calculated.

Furthermore, as a pre-exposure, the sample is exposed to white light of a halogen lamp 1 for 0.2 seconds using a shutter 2. After leaving it alone for 0.2 seconds, a high voltage Va is applied thereto and then it is left standing for 0.2 seconds. Thereafter, a second exposure is conducted by illuminating the sample for 0.2 seconds. The change in voltage of the sample caused thereby is measured. From the measured value, a calculation is made to know Vp', that is, the voltage applied to the photoconductive layer of the sample prior to the second exposure.

Vp and Vp' when Va is −2000 V, and Vp when Va is +2000 V are measured, and then the speed of photodecay regarding the pre-exposure is judged by the value of (Vp−Vp') when Va is −2000 V.

According to the procedure described above, tests were conducted with the sample of Example 1 left standing under illumination of light (referred to as "sample in light") and the sample of Example 1 stored in the dark (referred to as "sample in dark"). For the sake of comparison, those samples prepared in Comparative Example 1 were also tested in the same manner. As Va, −2000 V and +2000 V were used. When Va was −2000 V, the values Vp and Vp' were measured and when Va was +2000 V, only Vp was measured. The above-mentioned Vp, −Vp' and Vp−Vp' obtained when Va=−2000 V are tabulated below.

The results were as follows:

| Sample | | Va= −2000V Vp(−) | Va= +2000V Vp(+) | Va= −2000V Vp − Vp' |
|---|---|---|---|---|
| Example 1 | in dark | 1100V | 900V | 90V |
| | in light | 1100V | 900V | 50V |
| Comparative Example 1 | in dark | 1000V | 670V | 350V |
| | in light | 1000V | 710V | 200V |

From the above table it is seen that the samples of Example 1 are larger in both of Vp(−) and Vp(+) than those of Comparative Example 1. This demonstrates that the photosensitive medium prepared in Example 1 has a higher resistance than that of Comparative Example 1. The table also shows that the difference in Vp−Vp' between the sample in dark and the sample in light is relatively small in the photosensitive member of Example 1 as compared with that in the sample of Comparative Example 1. This demonstrates that the photosensitive member of Example 1 is less affected by the difference of storage conditions (whether in light or in dark) in respect of the speed of photodecay after pre-exposure. It is also seen from the table that the value of Vp−Vp' in the sample of Example 1 is smaller than that of the Comparative Example. This fact indicates that the speed of photodecay regarding preexposure is higher in the sample of Example 1 than in the sample of Comparative Example 1.

As another test to demonstrate the effect of the invention, image forming test was conducted on samples prepared according to the method described in Example 1 and also on comparative samples employing a copying machine. The copying machine used in the test was of the type comprising the steps of pre-exposure for erasing an electrostatic image formed in the preceding cycle, primary charging, AC charging simultaneous with imagewise exposure and whole surface exposure as its basic process. The results were as follows:

In the case of the comparative photosensitive member it was observed that the image produced after leaving the photosensitive member standing in the dark for a long time was thin. In contrast, when the photosensitive member of Example 1 was used, good quality images were continuously produced even after leaving the photosensitive member standing in the dark for a long time.

EXAMPLE 2

Samples of photosensitive members were prepared in accordance with the procedure described in Example 1 except that ferric chloride was replaced by 0.0011 g of nickel chloride or 0.0007 g of cobalt chloride. The samples were tested in the same manner as in Example 1. They exhibited the same good characteristics as those of Example 1.

What we claim is:

1. A photosensitive member for electrophotography having a photoconductive layer formed by dispersing photoconductive cadmium sulfide particles in a binder, wherein said photoconductive layer further contains an additive selected from the group consisting of iron, nickel, cobalt and compounds thereof dispersed in said binder separately from said photoconductive cadmium sulfide particles in an amount of $1\times10^{-5}$ to $6\times10^{-4}$ parts by weight of said additive to 1 part by weight of the binder.

2. A photosensitive member for electrophotography according to claim 1, wherein photoconductive cadmium sulfide particles are dispersed in a binder containing said additive.

3. A photosensitive member for electrophotography according to claim 1, wherein the amount of additive in said photoconductive layer is $5\times10^{-5}$ to $3\times10^{-4}$ parts by weight of said additive to one part by weight of the binder.

* * * * *